US005174440A

United States Patent [19]

Chiu

[11] Patent Number: 5,174,440

[45] Date of Patent: Dec. 29, 1992

[54] LIPSTICK CASE EQUIPPED WITH A SOUND GENERATING UNIT

[76] Inventor: Chung-Kuang Chiu, No. 291, Ta Shun Erh Rd., San-Min Dist., Kaohsiung City, Taiwan

[21] Appl. No.: 892,585

[22] Filed: Jun. 3, 1992

[51] Int. Cl.[5] ..... B65D 83/00; A45D 40/02

[52] U.S. Cl. ..... 206/38; 84/2; 84/94.2; 132/318; 132/320; 132/333; 206/823; 340/540; 340/692

[58] Field of Search ..... 84/2, 94.2, 95.2; 132/318, 320, 333; 206/38, 314, 581, 823, 216; 340/540, 692; 401/68, 75-78

[56] References Cited

U.S. PATENT DOCUMENTS

| | | | |
|---|---|---|---|
| 4,607,747 | 8/1986 | Steiner | 84/94.2 |
| 4,836,415 | 6/1989 | Grussmark | 206/216 |
| 4,866,807 | 9/1989 | Kreit et al. | 84/94.2 |
| 5,056,660 | 10/1991 | Huang | 84/2 |
| 5,119,932 | 6/1992 | Semanoff | 206/216 |
| 5,130,696 | 7/1992 | Liebman | 84/94.2 |

FOREIGN PATENT DOCUMENTS

| | | | |
|---|---|---|---|
| 2115387 | 9/1983 | United Kingdom | 132/320 |

*Primary Examiner*—Jimmy G. Foster

*Attorney, Agent, or Firm*—Poms, Smith, Lande & Rose

[57] ABSTRACT

A lipstick case includes a stationary tube formed with an axially extending guide slot, a rotatable tube formed with an internal spiral groove and rotatably sleeved on the stationary tube, and a lipstick base provided inside the stationary tube and receiving a lipstick therein. The lipstick base has an outward radial projection which extends into the guide slot and the spiral groove. A sound generating unit is provided on a lower end of the stationary tube and is operable so as to generate sound when the rotatable tube is rotated relative to the stationary tube in order to move the projection of the lipstick base upwardly along the guide slot and the spiral groove and thereby protrude the lipstick out of the stationary tube.

2 Claims, 3 Drawing Sheets

LIPSTICK CASE EQUIPPED WITH A SOUND GENERATING UNIT

BACKGROUND OF THE INVENTION

1. Field of the Invention

The invention relates to a lipstick case, more particularly to a lipstick case which is equipped with a sound generating unit.

2. Description of the Related Art

Referring to FIG. 1, a conventional lipstick case is shown to comprise a rotatable tube (10), a stationary tube (20) and upper and lower caps (30, 31). The rotatable tube (10) is provided inside a tubular sleeve (11) and is secured therein by means of adhesives. The rotatable tube (10) is provided with an internal spiral groove (12) and is sleeved on the stationary tube (20). The stationary tube (20) is formed with an axially extending guide slot (21) of predetermined length and upper and lower radial lip projections (22, 23). The lip projections (22, 23) retain the rotatable tube (10) on the stationary tube (20). A lipstick base (25) is provided inside the stationary tube (20) and receives a lipstick (90) therein. The lipstick base (25) has an outward radial projection (26) which extends into the guide slot (21) of the stationary tube (20) and the spiral groove (12) of the rotatable tube (10). The stationary tube (20) is provided inside a cylindrical sleeve (27) and is secured therein by means of adhesives. The cylindrical sleeve (27) is provided with an annular outward projection (28). The upper and lower caps (30, 31) cover the upper and lower portions of the cylindrical sleeve (27) on two sides of the outward projection (28). The lower cap (31) is preferably secured to the cylindrical sleeve (27) by means of adhesives.

Rotation of the tubular sleeve (11) in a first direction relative to the stationary tube (20) causes corresponding rotation of the rotatable tube (10), thereby enabling the radial projection (26) on the lipstick base (25) to move upwardly along the spiral groove (12) in the rotatable tube (10) and the guide slot (21) of the stationary tube (20). Upward movement of the lipstick base (25) can cause the lipstick (90) to protrude through the top open end of the tubular sleeve (11).

When retracting the lipstick (90) into tubular sleeve (11), the tubular sleeve (11) is rotated in an opposite second direction, thereby enabling the radial projection (26) on the lipstick base (25) to move downwardly along the spiral groove (12) in the rotatable tube (10) and the guide slot (21) in the stationary tube (20).

SUMMARY OF THE INVENTION

The objective of the present invention is to provide a lipstick case which is equipped with a sound generating unit that generates sound when a lipstick is protruded from the lipstick case.

Accordingly, the preferred embodiment of a lipstick case of the present invention includes a stationary tube which is formed with an axially extending guide slot, a rotatable tube which is formed with an internal spiral groove and which is rotatably sleeved on the stationary tube, and a lipstick base which is provided inside the stationary tube and which receives a lipstick therein. The lipstick base has an outward radial projection which extends into the guide slot and the spiral groove. A sound generating unit is provided on a lower end of the stationary tube and includes a switch means with a conductive leaf spring and a stationary switch terminal.

The lipstick base is provided with a downwardly extending switch actuator which moves the leaf spring away from the switch terminal so as to disable the sound generating unit when the lipstick is retracted into the stationary tube. The switch actuator moves upwardly with the lipstick base so as to depart from the leaf spring and enable the leaf spring to contact the switch terminal and activate the sound generating unit when the lipstick is protruded out of the stationary tube.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
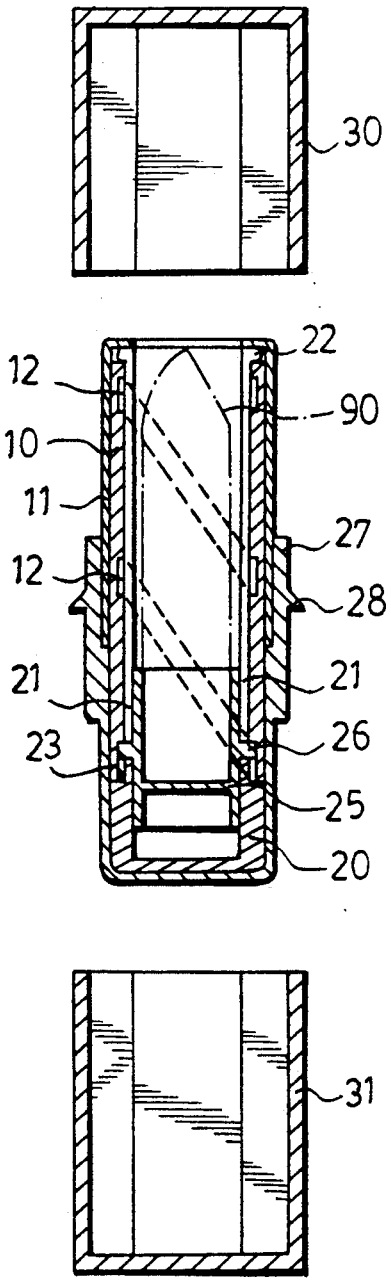
FIG. 1 PRIOR ART
FIG. 1 is an illustration of a conventional lipstick case.

Before proceeding with the detailed description of the preferred embodiment, it should be noted that like elements are indicated by the same reference numerals throughout the specification.

Figure 2:
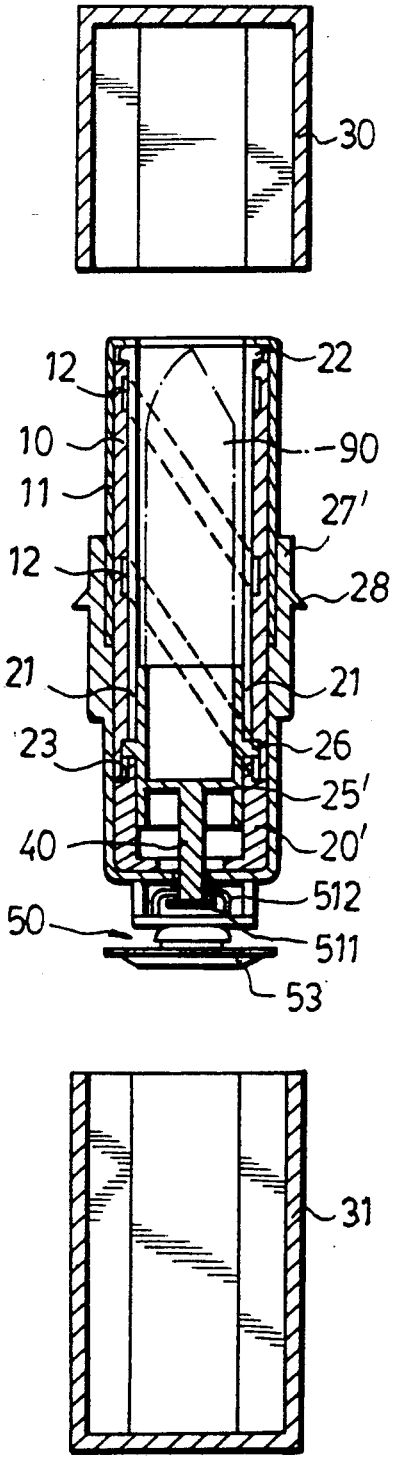
FIG. 2 illustrates the preferred embodiment of a lipstick case which is equipped with a sound generating unit in accordance with the present invention.

Referring to FIG. 2, the preferred embodiment is shown to include a rotatable tube (10), a stationary tube (20'), upper and lower caps (30, 31) and a sound generating unit (50). The construction of the rotatable tube (10) and the stationary tube (20') and the structural connection between the same is substantially similar to the prior art and will not be detailed further.

The main differences between the preferred embodiment and the conventional lipstick case shown in FIG. 1 are as follows: A downwardly extending switch actuator (40) is provided at the bottom side of the lipstick base (25') and controls the operation of the sound generating unit (50). The sound generating unit (50) is preferably received in the lower cap (31).

Figure 3:
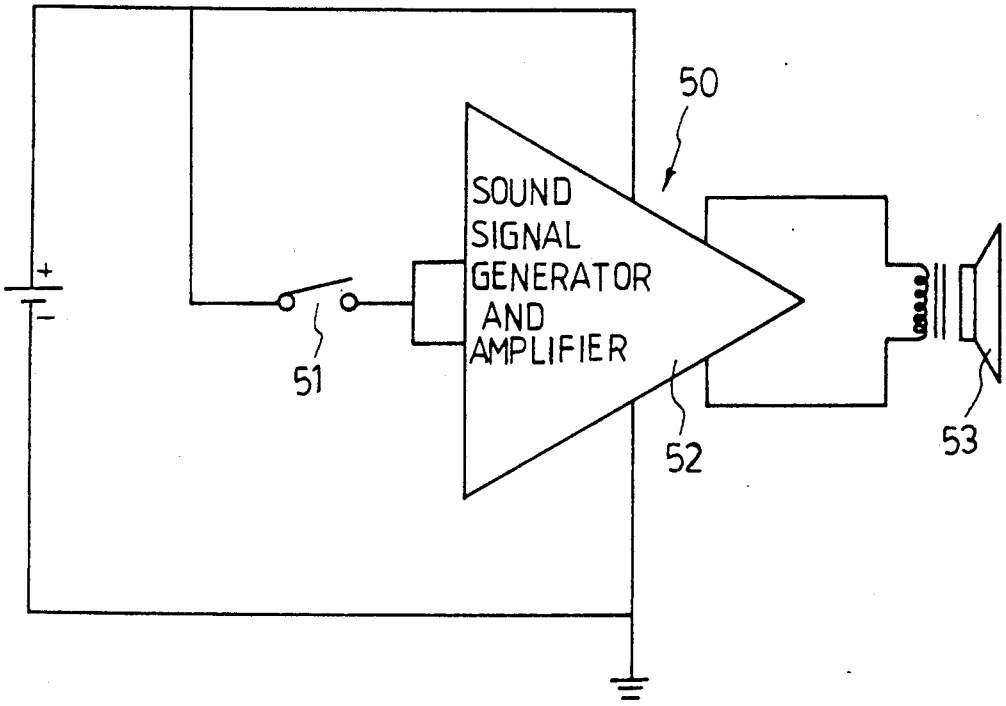
FIG. 3 is a schematic electrical circuit diagram of the sound generating unit of the preferred embodiment.

FIG. 3 is a schematic electrical circuit diagram of the sound generating unit (50). The sound generating unit (50) is shown to comprise a switch means (51), a sound signal generator and amplifier (52) and a loudspeaker (54). Referring to FIG. 2, the switch means (51) includes a conductive leaf spring (511) and a stationary switch terminal (512). The sound signal generator and amplifier (52) is activated whenever the leaf spring (511) contacts the switch terminal (512), thereby providing an electrical signal to the loudspeaker (53) so as to generate sound. The sound signal generator and amplifier (52) is deactivated whenever the leaf spring (511) is moved away from the switch terminal (512), thereby preventing the loudspeaker (53) from generating sound.

Figure 4:
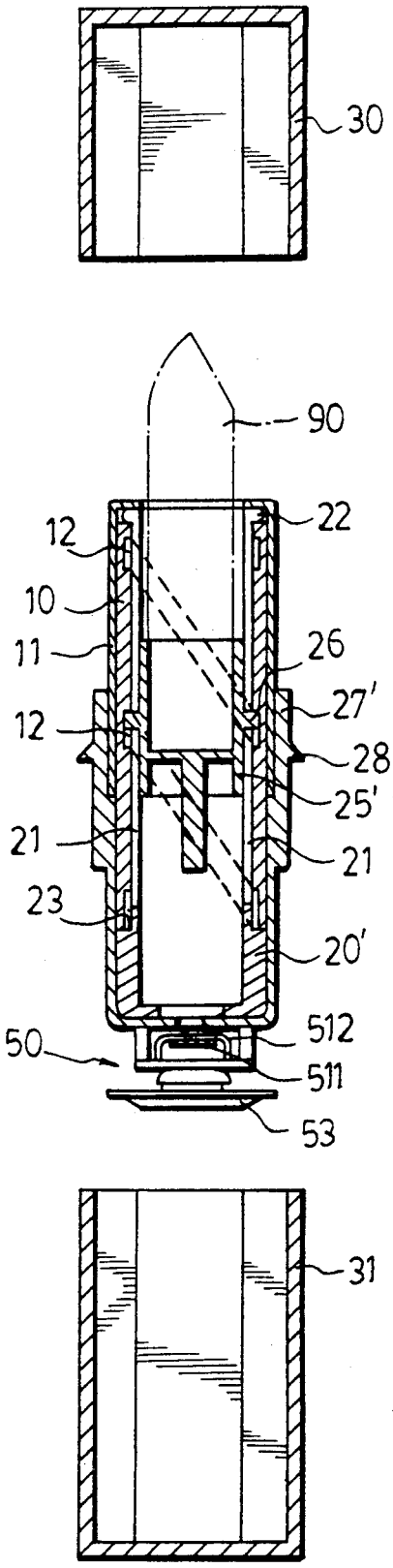
FIG. 4 illustrates the preferred embodiment when a lipstick is protruded therefrom.

Referring to FIG. 2, the switch actuator (40) extends through the bottom ends of the stationary tube (20') and the cylindrical sleeve (27') so as to move the leaf spring (511) away from the switch terminal (512) and therefore disable the sound generating unit (50) when the lipstick (90) is retracted in the tubular sleeve (11). Upward movement of the lipstick base (25') relative to the stationary tube (20') so as to protrude the lipstick (90)

through the open end of the tubular sleeve (11) causes the switch actuator (40) to depart from the leaf spring (511), as shown in FIG. 4. The leaf spring (511) contacts the switch terminal (512) at this stage, thereby activating the sound generating unit (50) so as to generate a sound output. The sound output may be a relaxing or romantic tune which can help soothe and calm the user.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A lipstick case, including a stationary tube formed with an axially extending guide slot, a rotatable tube formed with an internal spiral groove and rotatably sleeved on said stationary tube, and a lipstick base provided inside said stationary tube and receiving a lipstick therein, said lipstick base having an outward radial projection which extends into said guide slot and said spiral groove, wherein the improvement comprises:

a sound generating unit provided on a lower end of said stationary tube and operable so as to generate sound when said rotatable tube is rotated relative to said stationary tube in order to move said projection of said lipstick base upwardly along said guide slot and said spiral groove and thereby protrude said lipstick out of said stationary tube.

2. The lipstick case as claimed in claim 1, wherein:

said sound generating unit comprises a switch means which includes a conductive leaf spring and a stationary switch terminal; and said lipstick base being provided with a downwardly extending switch actuator which moves said leaf spring away from said switch terminal so as to disable said sound generating unit when said lipstick is retracted into said stationary tube, said switch actuator moving upwardly with said lipstick base so as to depart from said leaf spring and enable said leaf spring to contact said switch terminal and activate said sound generating unit when said lipstick is protruded out of said stationary tube.

* * * * *